US005492332A

United States Patent [19]

Hessnice

[11] Patent Number: 5,492,332

[45] Date of Patent: Feb. 20, 1996

[54] CHESS-TYPE GAME

[76] Inventor: Joseph D. Hessnice, 1301 Anderson St., Wilson, N.C. 27893

[21] Appl. No.: 380,726

[22] Filed: Jan. 30, 1995

[51] Int. Cl.[6] ..... A63F 3/02

[52] U.S. Cl. ..... 273/261

[58] Field of Search ..... 273/242, 243, 273/260, 261

[56] References Cited

U.S. PATENT DOCUMENTS

| | | | |
|---|---|---|---|
| 3,700,242 | 10/1972 | Sterler | 273/261 |
| 3,730,527 | 5/1973 | Nelson | 273/261 X |
| 5,158,302 | 10/1992 | Rewega | 273/261 |
| 5,209,488 | 5/1993 | Kimball | 273/261 |

FOREIGN PATENT DOCUMENTS

| | | | |
|---|---|---|---|
| 14484 | 1/1881 | Germany | 273/261 |

*Primary Examiner*—William E. Stoll

*Attorney, Agent, or Firm*—John G. Mills & Associates

[57] ABSTRACT

This invention is a chess-type board game apparatus and method of playing the same with a modified chess board having a main rectangular playing field and a generally pentagonal shaped field extending from one side thereof. The playing field as a whole comprises one-hundred eighteen identifiable squares of alternating color arranged in fourteen rank and eleven file rows and being divided into identical right and left halves about a center file row. Ten of the squares function as barriers which are strategically placed and are not available for occupancy by a playing piece. The playing field includes a throne square which imparts enhanced movement capabilities to playing pieces. The game is played by two opponents, each using ten playing pieces corresponding to the queen, knight, rook, and bishop of the conventional game of chess, each of the two sets of playing pieces being positioned at predetermined locations occupying the outer rank and file rows contained in the main rectangular field at the commencement of a game.

11 Claims, 4 Drawing Sheets

CHESS-TYPE GAME

FIELD OF INVENTION

The present invention relates to a board game apparatus and more particularly to a chess-type board game apparatus and method of playing the same.

BACKGROUND OF INVENTION

Chess is a well known game of strategy. The game is typically played on a rectangular checkerboard, the configuration of which has not changed significantly over the years, and according to rules which have remained basically unchanged throughout recent history. The conventional game of chess is an international pastime and has a devoted following; however, a substantial number of players enjoy new developments and variations to the game.

In recent years a variety of modified chess game boards and rules have been introduced in an effort to make the game of chess more interesting. For example, multiple-player chess and three dimensional chess game boards utilizing either conventional sets of chess playing pieces or a reduced number of playing pieces have been developed.

While some players may find this challenging, many non-skilled players still find the conventional game of chess and the modified chess games to be rather monotonous and difficult due to the long periods of play required and the intense concentration required during the course of play.

Further, the complexity of these games often intimidates these people from even attempting to learn the game of chess.

Other modified chess games have utilized a standard die to introduce the element of chance in order to equalize the role of the skills of two players when one is more proficient. However, such games are still relatively complex and time consuming.

The present invention provides a solution to these problems by providing a chess-type game that preserves the intellectual strategies of conventional chess in combination with novel rules of play and strategy options, while remaining accessible to the non-skilled or beginning chess player.

CONCISE EXPLANATION OF PRIOR ART

U.S. Pat. No. 3,873,101 to William S. Kelly discloses a chess-type board game apparatus utilizing a modified game board and a reduced number of traditional chess game pieces.

U.S. Pat. No. 4,778,187 to Joseph W. Deak, Jr., discloses a method for playing a modified chess game on a modified chess board having an extended playing surface and utilizing two to four sets of conventional chess pieces.

U.S. Pat. No. 5,125,666 to Timothy J. Adams discloses a modified chess game intended for four players including a plurality of conventional sets of playing pieces and an extended playing surface.

U.S. Pat. No. 1,780,038 to George S. Parker discloses a chess-type board game apparatus having an extended playing surface and modified rules for movement of the playing pieces.

U.S. Pat. No. 4,927,157 to Clayton Riihiluoma, et al., discloses a chess-type board game apparatus having a multilevel game board and a reduced number of playing pieces from the conventional game of chess. A die is utilized to introduce the element of chance.

Finally, U.S. Pat. No. 3,730,527 to Charles R. Nelson discloses a board game apparatus having a modified, checkerboard playing surface and game pieces which may move according to rules related to the game of chess.

BRIEF DESCRIPTION OF INVENTION

After much research and study into the above mentioned problems, the present invention has been developed to provide a chess-type board game which combines the intellectual challenge of the conventional game of chess with simplified rules of play and strategy options that make the game more interesting to beginners and experienced players alike.

The present invention relates to a game board apparatus for a chess-type game having a plurality of playing pieces. The instant game utilizes conventional chess rules in relation to most playing pieces and their movement. The game board apparatus comprises a modified, checkerboard playing surface defining a plurality of positions or squares arranged in perpendicular rank and file rows. These positions are distinguished as alternating black and white checkerboard squares.

Red barrier squares for obstructing the movement of the playing pieces and for preventing the occupancy of the barrier squares by a playing piece are dispersed on the game board in predetermined locations.

The game board also includes a throne square that functions to enhance the movement capabilities of playing pieces and may also serve as a winner's square in a shortened version of the instant game.

The board game apparatus further includes two sets of playing pieces, each of the sets of the playing pieces being distinguishable from the other set, each set containing ten playing pieces identified as corresponding to the queen, bishop, knight and rook of the conventional chess game.

The instant game also includes a jester playing piece which functions as a bonus playing piece and introduces new strategy options to the conventional rules of play.

The present invention further relates to a method of playing the chess-type board game. The method comprises steps of positioning each set of playing pieces at predetermined positions along the edge of the game board, and the players alternately moving one of the playing pieces on the surface of the game board in accordance with predetermined game rules in order to capture the opponent's queen.

In view of the above, it is an object of the present invention to provide a chess-type board game that serves as a tool for introducing the non-skilled or beginner players to the basic concepts of conventional chess which is both stimulating and interesting.

Another object of the present invention is to provide a chess-type board game with a reduced number of playing pieces resulting in an overall reduction in the complexity of the game.

Another object of the present invention is to provide a chess-type board game wherein the difference in relative skill levels between the players is not as noticeable due to the reduced complexity of the rules thereby providing for more even contests between players.

Another object of the present invention is to provide a chess-type board game which incorporates barriers on the playing surface that are utilized as a functional part of the overall game strategy.

Another object of the present invention is to provide a chess-type board game that involves varying degrees of strategy and can be enjoyed by beginner and experienced players alike.

Other objects and advantages of the present invention will become apparent and obvious from a study of the following description and the accompanying drawings which are merely illustrative of such invention.

DETAILED DESCRIPTION OF INVENTION

Figure 1:
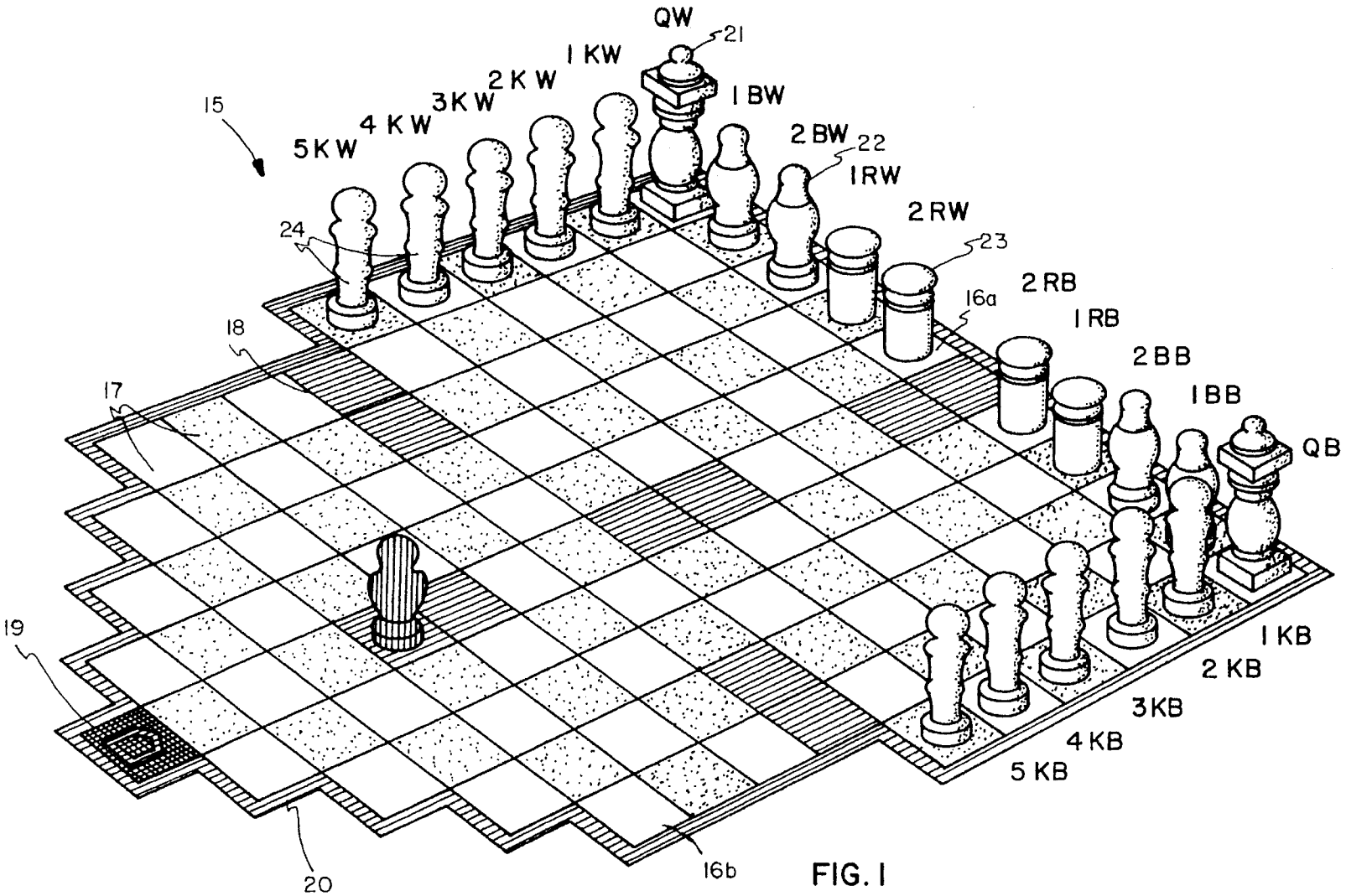
FIG. 1 is a perspective view of the present invention including the game board and playing pieces at the commencement of the game.
Figure 2:
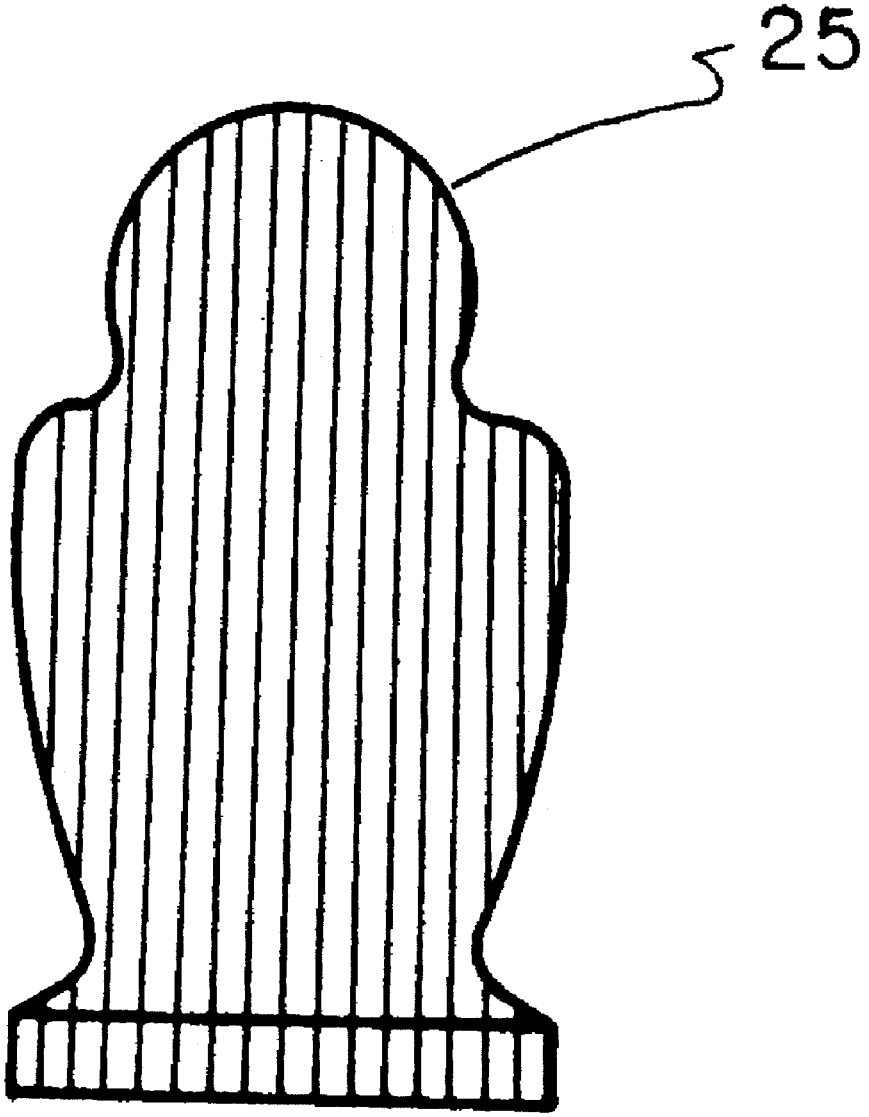
FIG. 2 is a side elevational view of the jester playing piece of the present invention.

With further reference to the drawings, a chess-type board game in accordance with the present invention is illustrated in FIG. 1. and indicated generally at 15. In the embodiment shown, the game apparatus 15 includes a relatively flat game board 16 including a generally rectangular field 16*a* and a generally pentagonal field 16*b*. Game board 16 is divided into identical right and left halves by a plane of symmetry extending through the center file row of the playing fields 16*a* and 16*b*. Game board 16 comprises a total of one-hundred eighteen positions or squares 17 of alternating color juxtaposed to one another so as to form a checkerboard pattern. In a preferred embodiment, squares 17 have an alternating black and white color scheme.

Playing squares 17 of game board 16 are arranged perpendicularly in fourteen rank rows and eleven file rows with a predetermined portion of the rank and file rows being deleted from the game board 16 about the periphery of the pentagonal field 16*b*, as shown in FIG. 1. Game board 16 comprises fifty-two black squares and fifty-five white squares 17 in the positions illustrated FIG. 1.

Game board 16 also includes ten red barrier squares 18. Red barrier squares 18 present obstructions to playing piece movement and prohibit occupancy of the position by a playing piece. As shown in FIG. 1., red barrier squares 18 are disposed symmetrically on game board 16 in strategic positions and may be utilized in blocking an opponent's attack.

Game board 16 also includes a throne square 19 located at the top, center position of pentagonal field 16*b* as shown in FIG. 1. Throne square 19 appears in gold, red and blue colors in the preferred embodiment of the present invention. Throne square 19 provides enhanced movement abilities to the queen playing pieces during the course of play as hereinafter described. A red border 20 may be utilized to define the boundaries of the playing surface.

The playing pieces of the present invention as shown in FIG. 1, include two identical sets of playing pieces, the sets being differentiated from ore another by color. Each set contains ten playing pieces with each of the playing pieces in a set being distinguishable from the other members of the set.

In the preferred embodiment, the playing pieces comprise a queen 21, two bishops 22, two rooks 23 and five knights 24. The playing pieces correspond to the queen, bishop, rook, and knight playing pieces in the conventional game of chess except that the queen's movements are modified as hereinafter described.

An additional playing piece identified as the jester 25 participates as a bonus playing piece and may join either the black or white set depending on which set activates jester 25 during the game as hereinafter described.

In FIG. 1, the playing pieces are shown in their starting positions at the commencement of a game. The corresponding letters and numbers for each playing piece in conventional chess nomenclature are defined in the table below:

| PLAYING PIECE | RED | WHITE | BLACK |
|---|---|---|---|
| Queen | | QW | QB |
| 1st Bishop | | 1BW | 1BB |
| 2nd Bishop | | 2BW | 2BB |
| 1st Rook | | 1RW | 1RB |
| 2nd Rook | | 2RW | 2RB |
| 1st Knight | | 1KW | 1KB |
| 2nd Knight | | 2KW | 2KB |
| 3rd Knight | | 3KW | 3KB |
| 4th Knight | | 4KW | 4KB |
| 5th Knight | | 5KW | 5KB |
| Jester | JR | | |

Figure 3:
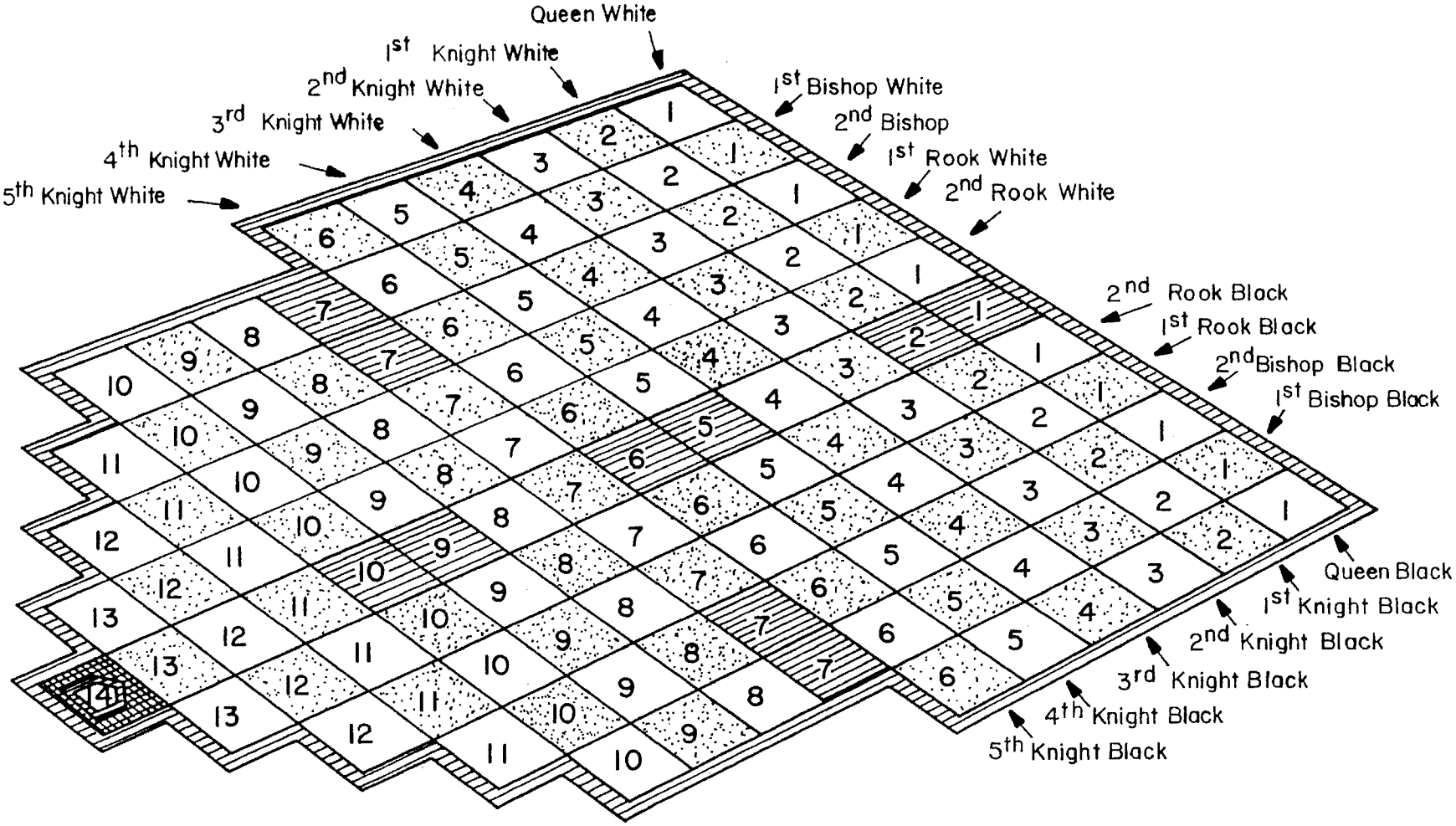
FIG. 3 is a perspective view of the game board of the present invention illustrating the numerical names of each game board position including game piece placement.

Starting positions for the playing pieces are illustrated in FIG. 3 as specific numbered positions. It will be appreciated that unlike the conventional chess game board, the right and left sides of game board 16 of the present invention are identical. This feature allows some flexibility over the conventional game of chess, in that either black or white may start on either side of game board 16.

The following table shows the starting position of each playing piece with the white set on the right side of the board using conventional chess nomenclature and corresponds to the positions illustrated in FIG. 3.

| WHITE PLAYING PIECE | | SQUARE | BLACK PLAYING PIECE | SQUARE |
|---|---|---|---|---|
| QW | | QW1 | QB | QB1 |
| 1BW | | 1BW1 | 1BB | 1BB1 |
| 2BW | | 2BW1 | 2BB | 2BB1 |
| 1RW | | 1RW1 | 1RB | 1RB1 |
| 2RW | | 2RW1 | 2RB | 2RB1 |
| 1KW | | QW2 | 1KB | QB2 |
| 2KW | | QW3 | 2KB | QB3 |
| 3KW | | QW4 | 3KB | QB4 |
| 4KW | | QW5 | 4KB | QB5 |
| 5KW | | QW6 | 5KB | QB6 |
| | JR | C10 | | |

The objective of the present invention, similar to that of conventional chess, is to capture the opponent's queen by forcing the opponent's queen into a position where there is no escape and by moving a playing piece to the square occupied by the opponent's queen.

The queen 21 of the present invention is of such importance that without it, the game is lost. At the outset of a game, queen 21 moves exactly as a conventional chess king, that is, only one square at a time in any direction.

In the preferred method of play, when queen 21 progresses to reach and occupy throne square 19, queen 21 is imparted with movement capability equal to that of a conventional chess queen. It will be appreciated that both black and white queens 21 may reach and occupy throne square 19 during the course of a game at different times and obtain such enhanced movement capability.

At the commencement of a game, jester 25 is positioned at a predetermined location corresponding to position center 10, which is also a red barrier square 18, as shown in FIG. 3. Jester 25 awaits the moment in a game when a knight 24 leaps over jester 25 activating its participation in the game and joining with whichever side such knight 24 belonged, as illustrated in FIG. 4.

Figure 4:
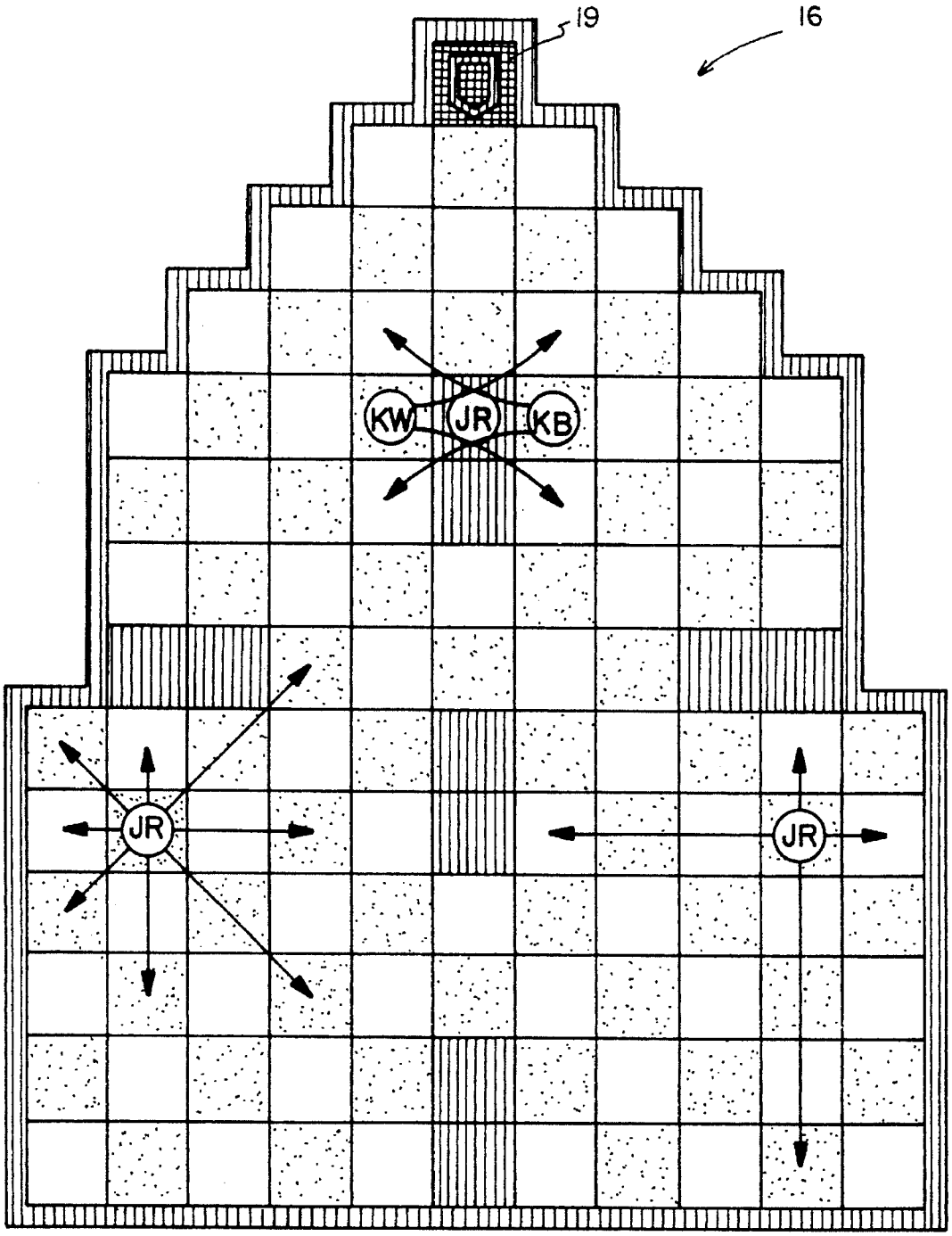
FIG. 4 is a plan view of the game board of the present invention illustrating activation of the jester playing piece and the movement of same.

As will be seen in FIG. 4, jester's movement is one or two squares straight or diagonal in any direction. In addition, jester 25 may leap over either black or white playing pieces and red barrier squares 18. However, jester 25 may never occupy a red barrier square 18 except at the commencement of the game.

Jester 25 may not capture any playing piece nor is the opposing side permitted to capture the jester. At this stage jester 25 may only be used as a moveable obstacle to block an opponent's movement or to block an attack because no other playing piece is permitted to pass over jester 25 with the exception of knight 24.

Jester 25 also has a second stage of movement capability which comes into effect when jester's queen 21 initially occupies throne square 19. At that moment jester 25 forfeits the moveable obstacle capability previously described and obtains the complete role of a conventional chess rook 23.

When jester 25 is utilized the game strategy increases as both players compete to activate and add this extra playing piece to their side. However, if preferred, the game may be played without using jester 25 and the related blocking strategies and movement capability that it provides.

The instant game progresses according to the conventional rules of chess except for the novel features recited herein. A game is concluded when either a player's queen 21 is captured.

In an alternative or shortened method of play, the objective of the game is to be the first queen 21 to occupy the throne square 19. At that point the player whose queen occupies throne square 19 is declared winner of the game.

From the above it can be seen that the chess-type board game apparatus of the present invention will provide a novel game for introducing beginning players to the basic concepts of conventional chess, but also involves varying degrees of strategy and game options which can be enjoyed by experienced players.

The terms "top", "center", "right", "left" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

I claim:

1. A board game apparatus for a chess-type game comprising:

two sets of distinguishable game pieces; and a generally flat game board defining a playing surface with a plurality of identifiable playing squares, said playing surface including a main rectangular field and a generally pentagonal field juxtaposed symmetrically to a side edge of said rectangular field, said playing surface having a plurality of non-playing, barrier squares presenting obstructions to playing piece movement, only one of said identifiable playing squares having indicia indicating that it is a throne square that functions to impart enhanced movement capability to playing pieces moved thereon.

2. The board game apparatus of claim 1 wherein said playing surface as a whole comprises one-hundred eighteen identifiable squares of alternating color arranged symmetrically in fourteen rank and eleven file rows whereby said playing surface is divisible into identical right and left halves about a center file row of fourteen squares.

3. The board game apparatus of claim 2 wherein one-hundred eight of said one-hundred eighteen identifiable squares are available for occupancy and movement thereacross by playing pieces, ten of said identifiable squares being non-playing barrier squares disposed at predetermined locations on said playing surface.

4. The board game apparatus of claim 3 wherein each of said sets of distinguishable playing pieces contain ten playing pieces including one queen, two bishops, two rooks, and five knights of the conventional game of chess.

5. The board game apparatus of claim 4 wherein said queen playing pieces are positioned in the first file rows from the end edges of said rectangular field, said bishop playing pieces are positioned in the second and third file rows from the end edges of said rectangular field, said rook playing pieces are positioned in the fourth and fifth file rows from the end edges of said rectangular field, and said knight playing pieces are positioned in the second, third, fourth, fifth, and sixth ranks of the first file row from the end edges of said rectangular field at the start of a game.

6. The board game apparatus of claim 5 wherein a jester playing piece functions as a bonus playing piece that may be added to either of said sets of distinguishable playing pieces.

7. The board game apparatus of claim 6 wherein said jester playing piece is positioned in the tenth rank of said center file row.

8. The method of playing a chess-type game by two players comprising:

providing a game board and a plurality of distinguishable sets of playing pieces, said game board having a plurality of identifiable playing squares of alternating color defining a main rectangular field and a generally pentagonal field juxtaposed symmetrically to a side edge of said rectangular field, said game board having a plurality of non-playing, barrier squares presenting obstructions to playing piece movement, only one of said identifiable playing squares having indicia indicating that it is a throne square that functions to impart enhanced movement capability to playing pieces moved thereon;

each player placing his playing pieces at predetermined locations occupying the outer rank and file rows contained in said main rectangular field of said playing surface at the start of a game;

each player, in turn, moving one of his playing pieces from one space on said playing surface to another according to certain restrictions on the movement capabilities of each piece;

any player during his turn moving his playing piece to a space occupied by an opponent's playing piece and simultaneously, removing the opponent's piece as an indication that the opponent's playing piece has been captured; and each player who during a turn moves his playing pieces in position to capture the opponent's queen in accordance with the rules of play, being declared the winner of a game.

9. The method of claim 8 wherein each player who during a turn moves his queen playing piece one space at a time in any direction to reach and occupy said throne space in accordance with the game rules, imparting said queen playing piece with the movement capability of a queen in the conventional game of chess.

10. The method of claim 9 wherein each player who during a turn moves his knight playing piece such that said knight leaps over a jester playing piece that is located at a predetermined position in said pentagonal field, adding said jester playing piece to the r side in accordance with the rules of said game; and each player who during a turn after adding said jester playing piece to his side moves his queen playing piece one space at a time in any direction to reach and occupy said throne square, imparting to said jester playing piece the moves of a conventional chess rook.

11. The method of claim 8 wherein each player who during a turn moves his queen playing piece one space at a time in any direction to reach and occupy said throne space in accordance with the game rules being declared the winner in a shortened version of said game.

* * * * *